US009181909B2

(12) United States Patent
Unes et al.

(10) Patent No.: US 9,181,909 B2
(45) Date of Patent: Nov. 10, 2015

(54) FUEL PUMP RETAINER

(71) Applicant: Caterpillar Inc., Peoria, IL (US)

(72) Inventors: John W. Unes, Chillicothe, IL (US); Eric Krause, Kewanee, IL (US); Steven R. Meinhart, Lafayette, IN (US); David C. Mack, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 234 days.

(21) Appl. No.: 14/028,595

(22) Filed: Sep. 17, 2013

(65) Prior Publication Data

US 2015/0075498 A1 Mar. 19, 2015

(51) Int. Cl.
*F02M 37/04* (2006.01)
*F02M 39/02* (2006.01)

(52) U.S. Cl.
CPC ..... *F02M 39/02* (2013.01)

(58) Field of Classification Search
CPC ..... F04B 39/16; F02M 37/22; F02M 37/221; F02M 37/223; F02M 2037/225; F02M 2037/226; F02M 2037/228
USPC ..... 123/495; 417/572; 210/416.4, 485
See application file for complete search history.

(56) References Cited

U.S. PATENT DOCUMENTS

| | | | | |
|---|---|---|---|---|
| 4,976,852 | A * | 12/1990 | Janik et al. | 210/86 |
| 7,699,738 | B2 | 4/2010 | Oomura | |
| 2004/0062663 | A1* | 4/2004 | Ikeya | 417/313 |
| 2006/0275163 | A1* | 12/2006 | Pike | 417/423.9 |

FOREIGN PATENT DOCUMENTS

| | | |
|---|---|---|
| WO | 2008099268 | 8/2008 |

* cited by examiner

*Primary Examiner* — Hung Q Nguyen
(74) *Attorney, Agent, or Firm* — John P. Wappel

(57) ABSTRACT

A fuel pump is disclosed. The fuel pump includes a housing. Further, the fuel pump includes a rotatable pump shaft disposed within the housing. One end of the rotatable pump shaft is attachable to a gear. The housing also includes a retainer disposed within the housing and located about the pump shaft. The retainer includes a first rim and a second rim that are spaced apart from each other. The retainer also includes a side wall extending between the first and the second rims. Further, the side wall of the retainer defines a first volume and a second volume within the housing. The side wall of the retainer has a plurality of apertures configured to allow a fluid flow from the first volume to the second volume while retaining particulate contaminants larger than a size of the apertures within the first volume.

20 Claims, 6 Drawing Sheets

FUEL PUMP RETAINER

TECHNICAL FIELD

The present disclosure relates to a retainer, and more particularly to the retainer disposed within a fuel pump.

BACKGROUND

Fuel injectors are configured to inject a pressurized fuel into cylinders of an engine. The fuel injectors receive the pressurized fuel from a fuel pump through a fuel rail. The fuel pump is mechanically coupled and driven by a gear train present within a gear case associated with the engine. Further, the engine may also include an engine oil pump. The engine oil pump supplies a lubricating oil to the fuel pump and various engine components. The lubricating oil may drain from the fuel pump into the gear case.

In some situations, when the fuel pump fails, debris from the failed fuel pump may mix with the lubricating oil. This contaminated oil containing the debris may flow towards and enter into the gear train and/or other components of the engine positioned downstream of the fuel pump. Further, this may lead to failure of the respective gear train and/or the engine components. The failure of these engine components may increase a cost and downtime associated with an operation of the engine.

U.S. Pat. No. 7,699,738 discloses an oil pump structure of an automatic transmission. In the oil pump structure of an automatic transmission using a torque converter, a hydraulic pressure chamber is defined by pump housing and a pump cover, to rotatably accommodate therein inner and outer rotors. First and second inflow ports respectively communicating with an oil strainer and a control valve are formed in the outside surface of the pump cover separately from each other. First and second oil inflow passages communicating with the respective inflow ports, a merged-flow portion that downstream portions of the first and second oil inflow passages are merged with each other, a downstream-side oil distribution channel intercommunicating a downstream side of the merged-flow portion and the hydraulic pressure chamber, are formed in at least one of the pump housing and the pump cover.

SUMMARY OF THE DISCLOSURE

In one aspect of the present disclosure, a fuel pump is disclosed. The fuel pump includes a housing. Further, the fuel pump includes a rotatable pump shaft disposed within the housing. One end of the rotatable pump shaft is attachable to a gear. A retainer is disposed within the housing and located about the rotatable pump shaft. The retainer includes a first rim and a second rim. The first rim and the second rim of the retainer are spaced apart from each other. The retainer also includes a side wall extending between the first rim and the second rim. Further, the side wall of the retainer defines a first volume and a second volume within the housing. The side wall of the retainer has a plurality of apertures configured to allow a fluid flow from the first volume to the second volume, while retaining particulate contaminants larger than a size of the apertures within the first volume.

In another aspect, a fuel pump is disclosed. The fuel pump includes a housing with a rotatable pump shaft disposed within the housing. One end of the rotatable pump shaft is attachable to a gear. A retainer is disposed within the housing and located about the rotatable pump shaft. The retainer includes a first rim and a second rim, such that the first rim and the second rim are spaced apart from and coaxial to each other. The retainer includes a substantially planar wall attached to and extending between the first rim and the second rim. Further, the planar wall of the retainer defines a first volume and a second volume within the housing. The planar wall of the retainer includes a plurality of apertures configured to allow a fluid flow from the first volume to the second volume, while retaining particulate contaminants larger than a size of the apertures within the first volume.

In yet another aspect, an engine is disclosed. The engine includes an engine block. The engine also includes a gear case having a gear train. The gear train includes one or more gears. The engine further includes a fuel pump mechanically coupled to the gear train. The fuel pump includes a housing. A rotatable pump shaft is disposed within the housing such that one end of the rotatable pump shaft is configured to cooperate with a gear of the gear train. Further, a retainer is disposed within the housing and located about the rotatable pump shaft. The retainer includes a first rim and a second rim. The first rim and the second rim of the retainer are spaced apart from each other. The retainer also includes a wall extending between the first rim and the second rim. The wall of the retainer defines a first volume and a second volume within the housing. The wall of the retainer has a plurality of apertures configured to allow a fluid flow from the first volume to the second volume while retaining particulate contaminants larger than a size of the apertures within the first volume.

Other features and aspects of this disclosure will be apparent from the following description and the accompanying drawings.

DETAILED DESCRIPTION

Figure 1:
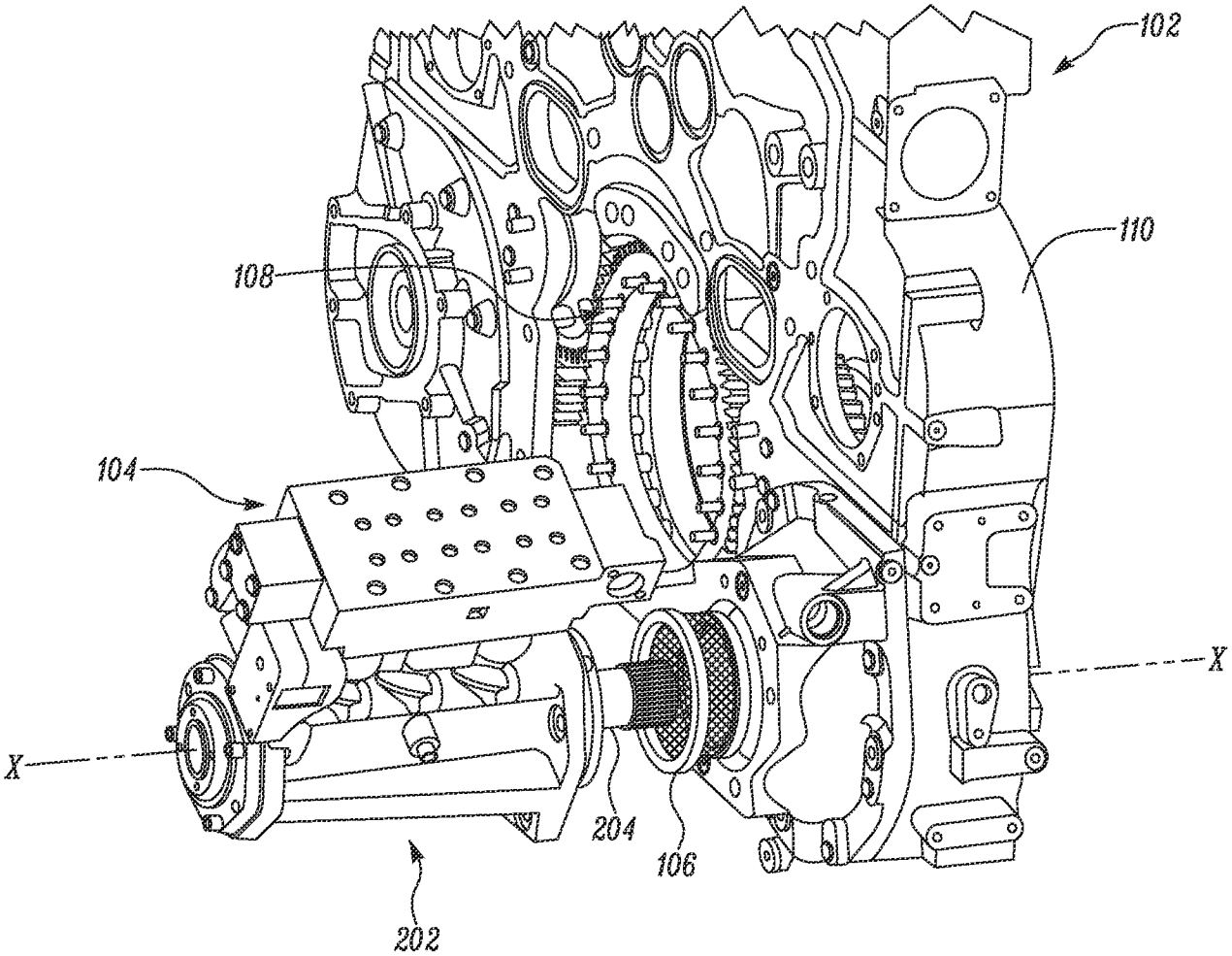
FIG. 1 shows a perspective exploded view illustrating a retainer, a gear case and a fuel pump, according to an embodiment of the present disclosure.

Wherever possible, the same reference numbers will be used throughout the drawings to refer to the same or the like parts. FIG. 1 illustrates a portion of an engine showing a gear case 102, a fuel pump 104 and a retainer 106. The engine may include an internal combustion engine that may be powered by any one or a combination of known liquid or gaseous fuels including, but not limited to, gasoline, diesel, natural gas, petroleum gas and bio-fuels. The gear case 102 includes a gear train 108 mounted on a gear plate 110. The gear plate 110 is mounted on an engine block (not shown) of the engine. The gear case 102 may be attached to the engine block using any conventional fastening means such as, for example, bolts. The gear train 108 is employed between a crankshaft (not shown) and various engine components to allow for torque transmission. For example, the gear train 108 may include radial gears 112 (shown in FIG. 2) for providing drive torque to the engine components like, for example, fuel pumps. Further, the gear train 108 may also includes idler gears for providing driving connections between the gears associated with the crankshaft and a camshaft (not shown), between the crankshaft and one or more of the radial gears 112 and so on.

The fuel pump 104 may be associated with the engine for delivery of pressurized fuel to a fuel rail (not shown) and into fuel injectors (not shown). During the operation of the engine, the fuel injectors are configured to inject the pressurized fuel into engine cylinders (not shown). The fuel pump 104 may include any of a gear pump, a trochoid pump, a vane pump, a plunger pump or any other pump known in the art based on system requirements. The fuel pump 104 is mechanically coupled to at least one gear 112 of the gear train 108.

Figure 2:
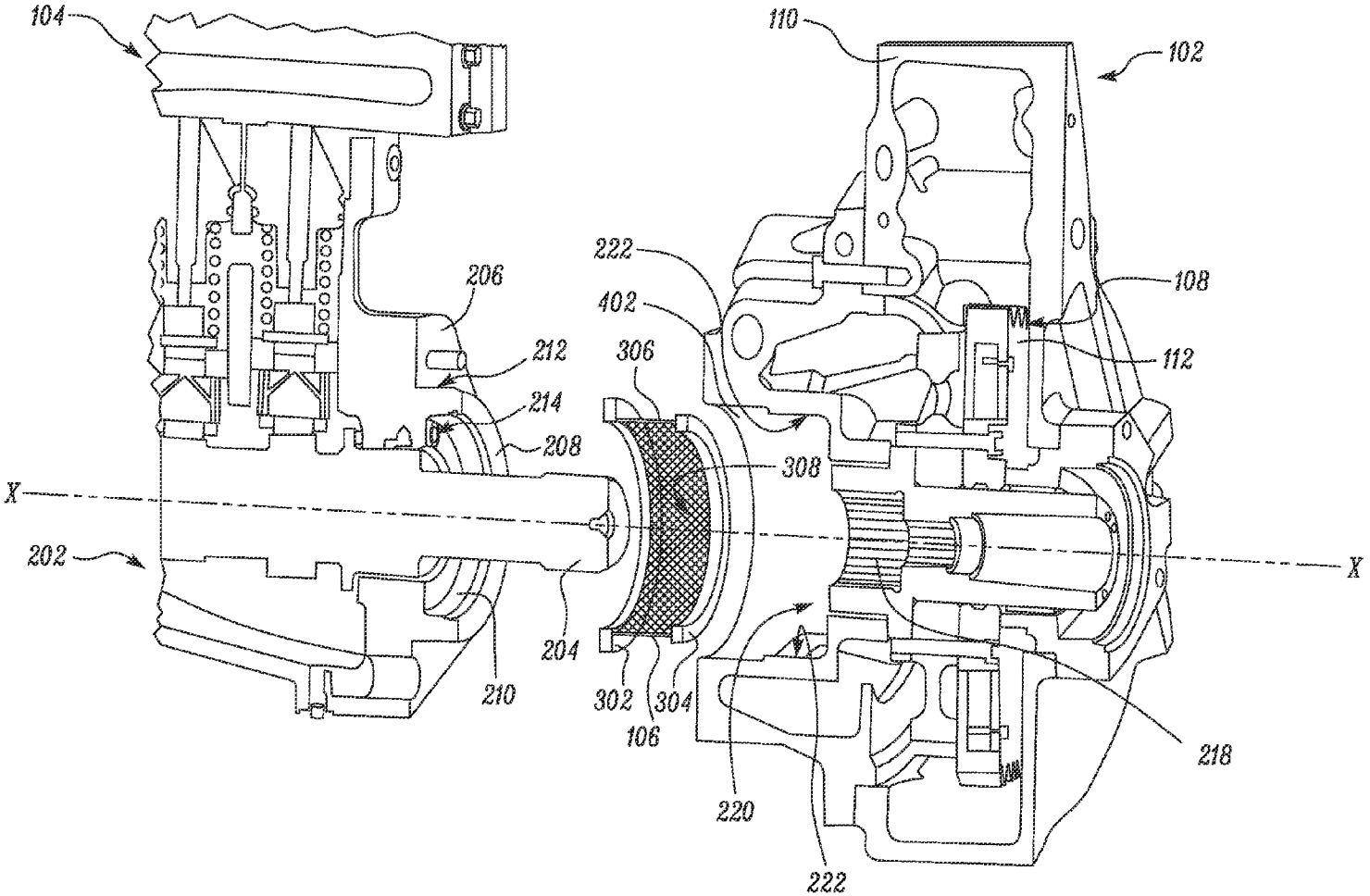
FIG. 2 shows an exploded cross sectional view of the retainer, the fuel pump and the gear case.

As illustrated in FIG. 2, the fuel pump 104 may include a housing 202. The fuel pump 104 also includes a rotatable pump shaft 204 extending along a longitudinal axis X-X defined by the pump shaft 204. The housing 202 of the fuel pump 104 further includes a front face 206 and a mounting surface 208 extending axially from the front face 206. The mounting surface 208 is disposed outwardly from and substantially coaxial with the longitudinal axis X-X. The mounting surface 208 includes an inner circumferential surface 210 and an outer circumferential surface 212.

An engine oil pump (not shown) may be associated with the engine for supplying lubricating fluid, such as, for example, oil, to the fuel pump 104 and other engine components. Further, the fuel pump 104 includes a plurality of internal channels 214 defined along the front face 206 of the pump 104 surrounding the pump shaft 204. The channels 214 provide a supply and return path for the lubricating oil.

One end of the pump shaft 204 is configured to be received by one of the gears 112 of the gear case 102. The pump shaft 204 may be inserted into a splined gear shaft 218 associated with any gear 112 within the gear case 102. During operation, the gear 112 may drive the pump shaft 204, which in turn may cause the pump 104 to run. Referring to FIG. 2, the gear case 102 may include a cavity 220 such that when assembled the cavity 220 cooperates with the mounting surface 208 and is configured to surround the pump shaft 204 when the fuel pump 104 is mounted. This cavity 220 on the gear case 102 may receive the lubricating oil draining out of the fuel pump 104 through the internal channels 214 provided therein.

A plurality of outlets 222 provided within the cavity 220 may provide a path for draining the lubricating oil from the fuel pump 104 into the gear case 102. In one embodiment, a pair of the outlets 222 is provided diametrically opposite to each other in a direction perpendicular to the longitudinal axis X-X.

Figure 3:
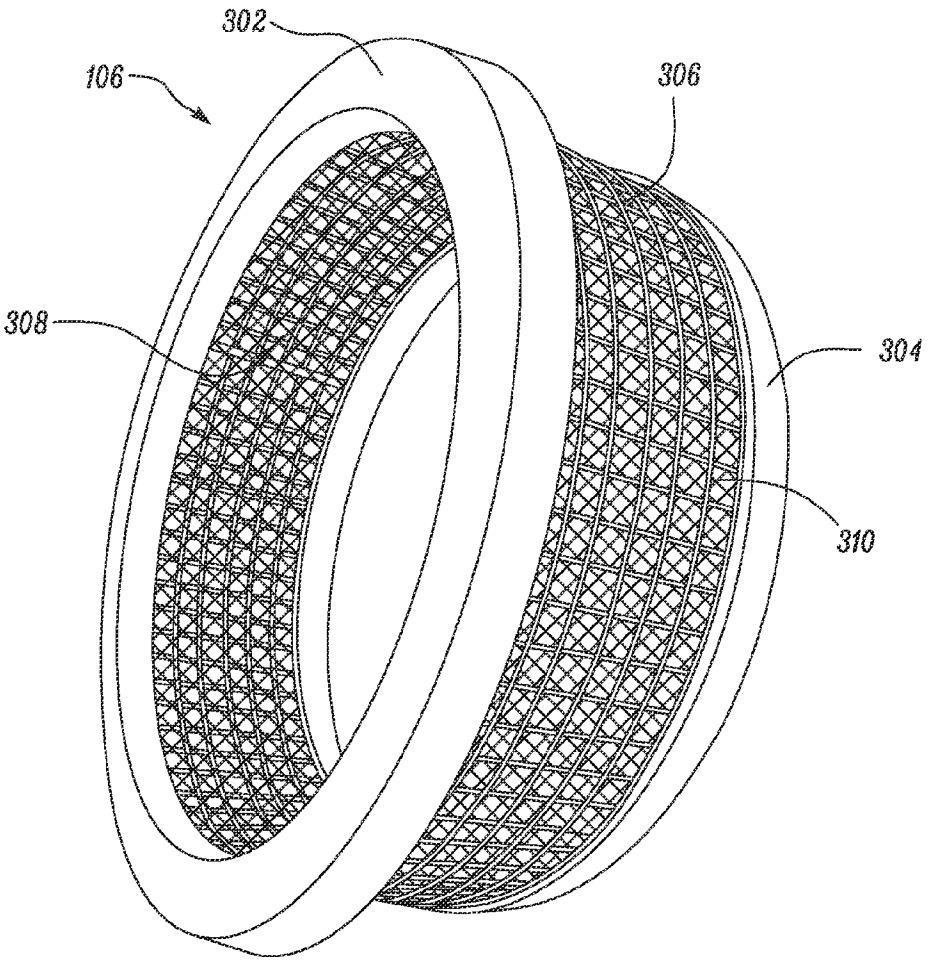
FIG. 3 shows one configuration of the retainer, according to one embodiment of the present disclosure.

FIG. 3 is a perspective view of an embodiment the retainer 106 according to the present disclosure. The retainer 106 may be positioned about the pump shaft 204 within the housing 202. FIGS. 1 to 4 show one configuration of the retainer 106, according to one embodiment of the present disclosure. Another configuration of the retainer 502 will be explained with reference to FIGS. 5 and 6.

Figure 4:
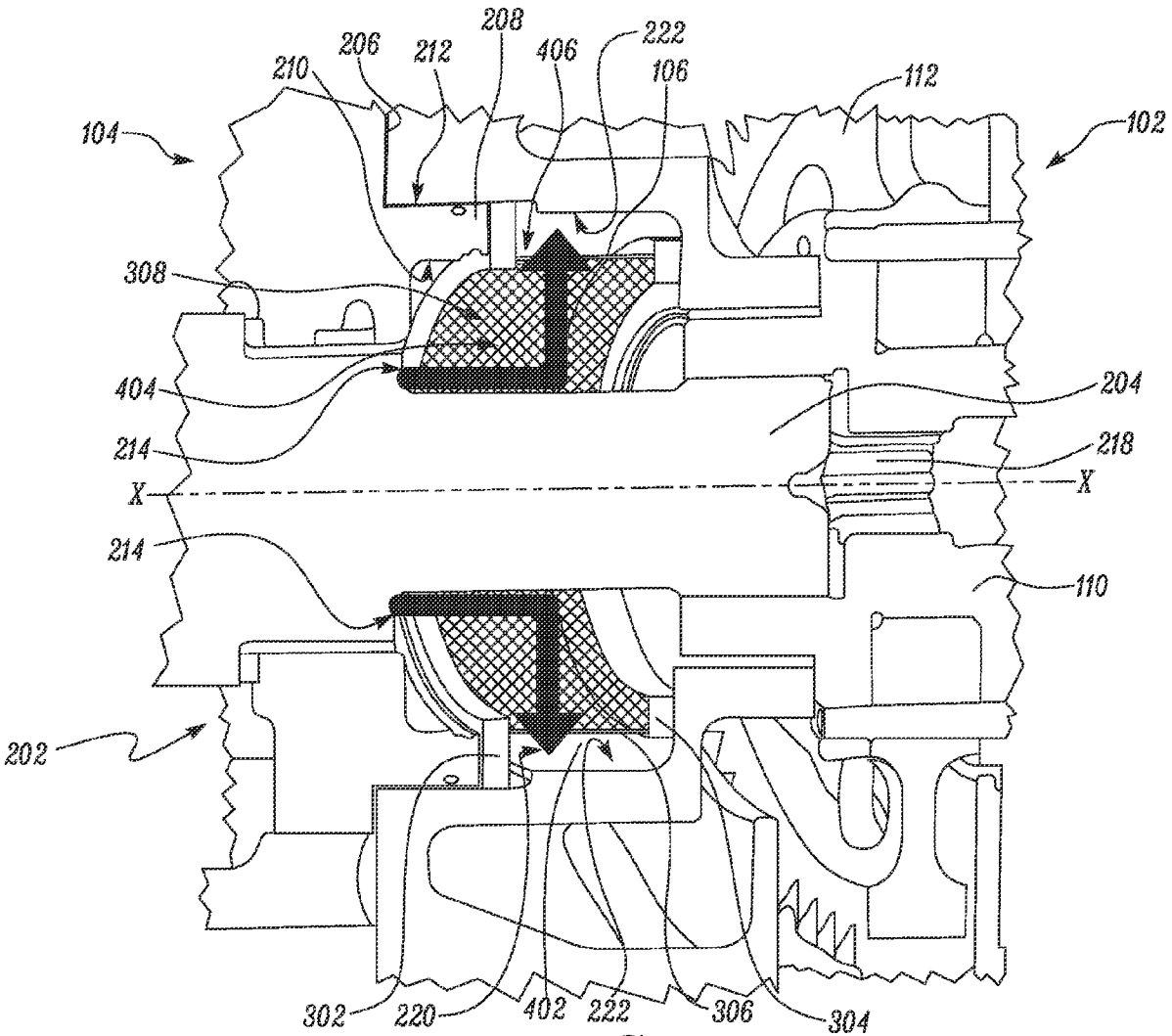
FIG. 4 shows a perspective cross sectional view of an assembly including the gear, the fuel pump and the retainer of FIG. 3.

Referring to FIG. 3, the retainer 106 includes a first rim 302 and a second rim 304. The first and second rims 302, 304 of the retainer 106 have a circular ring like structure. Further, the first and second rims 302, 304 of the retainer 106 are spaced apart from each other. As shown in FIGS. 1, 2 and 4, a diameter of the first and second rims 302, 304 of the retainer 106 is greater than a diameter of the pump shaft 204, such that the retainer 106 may surround the pump shaft 204. In one embodiment, the diameter of first and second rims 302, 304 of the retainer 106 may be approximately 3 to 5 times the diameter of the pump shaft 204. As shown, an inner diameter of the first and second rims 302, 304 may be substantially equal. It should be noted that the first and second rims 302, 304 may be made of any metal or polymer material known in the art.

The retainer 106 also includes a side wall 306 extending between the first and second rims 302, 304 of the retainer 106. In one embodiment, the side wall 306 may extend axially between the first and second rims 302, 304 such that, the side wall 306 may be substantially parallel to the longitudinal axis X-X of the pump shaft 204. In one embodiment, the side wall 306 may have a cylindrical configuration. Alternatively, in another embodiment, when the diameter of the first rim 302 is greater than the diameter of the second rim 304, the side wall 306 may be disposed between the first and second rims 302, 304 such that the cross section of the side wall 306 may gradually taper between the first and second rims 302, 304.

The side wall 306 of the retainer 106 includes a plurality of apertures 308. These apertures 308 may be circular holes, slots or may have any other shape. The apertures 308 of the side wall 306 may serve as a filter for preventing particulate contaminants having a size larger than a size of the apertures 308 from flowing towards the gear case 102 from the fuel pump 104. One of ordinary skill in the art will appreciate that the size of the apertures 308 must be so chosen that the comparatively larger particulate contaminants are separated and retained within the retainer 106, while the oil may be allowed to flow towards the gear case 102 through the retainer 106. In one embodiment, a multi-layer side wall 306 may be used for providing additional support. For example, the retainer 106 may include a three layered side wall 306.

Further, a mesh 310 may be provided on the side wall 306 of the retainer 106. The mesh 310 is positioned such that the mesh 310 may be located on an outer surface of the side wall 306 away from the pump shaft 204 when the retainer 106 is assembled thereon. The mesh 310 may provide mechanical strength to the side wall 306 of the retainer 106. It should be noted that the side wall 306 and the mesh 310 may be made from any metal or polymer known in the art, for example, aluminum, steel, polytetrafluoroethylene (PTFE), polyvinylchloride (PVC) and the like.

Operation of the retainer 106 will now be described in detail. FIG. 4 is a perspective view of a cross section of the retainer 106, the fuel pump 104 and the gear case 102. When assembled, the outer circumference 212 of the mounting surface 208 of the fuel pump 104 is in contact with and rests within an inner surface 402 of the cavity 220. The retainer 106 is located about the pump shaft 204 such that the retainer 106 is positioned within the cavity 220.

Lubricating oil may drain from the fuel pump 104, through the retainer 106, and into the gear case 102. The side wall 306 of the retainer 106 defines a first volume 404 and a second volume 406 with respect to the oil flow from the fuel pump 104 into the gear case 102. The first volume 404 is defined on an interior side of the side wall 306 with respect to the oil flow, between the side wall 306 and the pump shaft 204. The second volume 406 is defined on an outer side of the side wall 306 with respect to the oil flow. In the illustrated embodiment, the second volume 406 may be positioned radially outwards of the first volume 404 and in oil communication with the gear train 108 of the gear case 102.

As shown by arrows in the accompanying figures, the lubricating oil may flow along the longitudinal axis X-X of the pump shaft 204. The oil may flow out of the first volume 404 by being routed through the side wall 306 of the retainer 106 in a radial direction. The plurality of apertures 308 provided in the side wall 306 may allow for the particulate contaminants present within the oil flow to be retained within the first volume 404. Apertures 308 are sized to be smaller than contaminants that may physically damage the gear train 108 yet large enough to allow lubricating oil to flow through without a significant pressure drop. For example, the apertures 308 may be sized as small as approximately 100 microns. In another example, the apertures 308 may be larger than 100 microns. The size of the apertures 308 may vary based on the level of protection required. Thus, the lubricating oil is separated of the contaminants and may flow into the second volume 406 and drain into the gear case 102 through the outlets 222.

Figure 5:
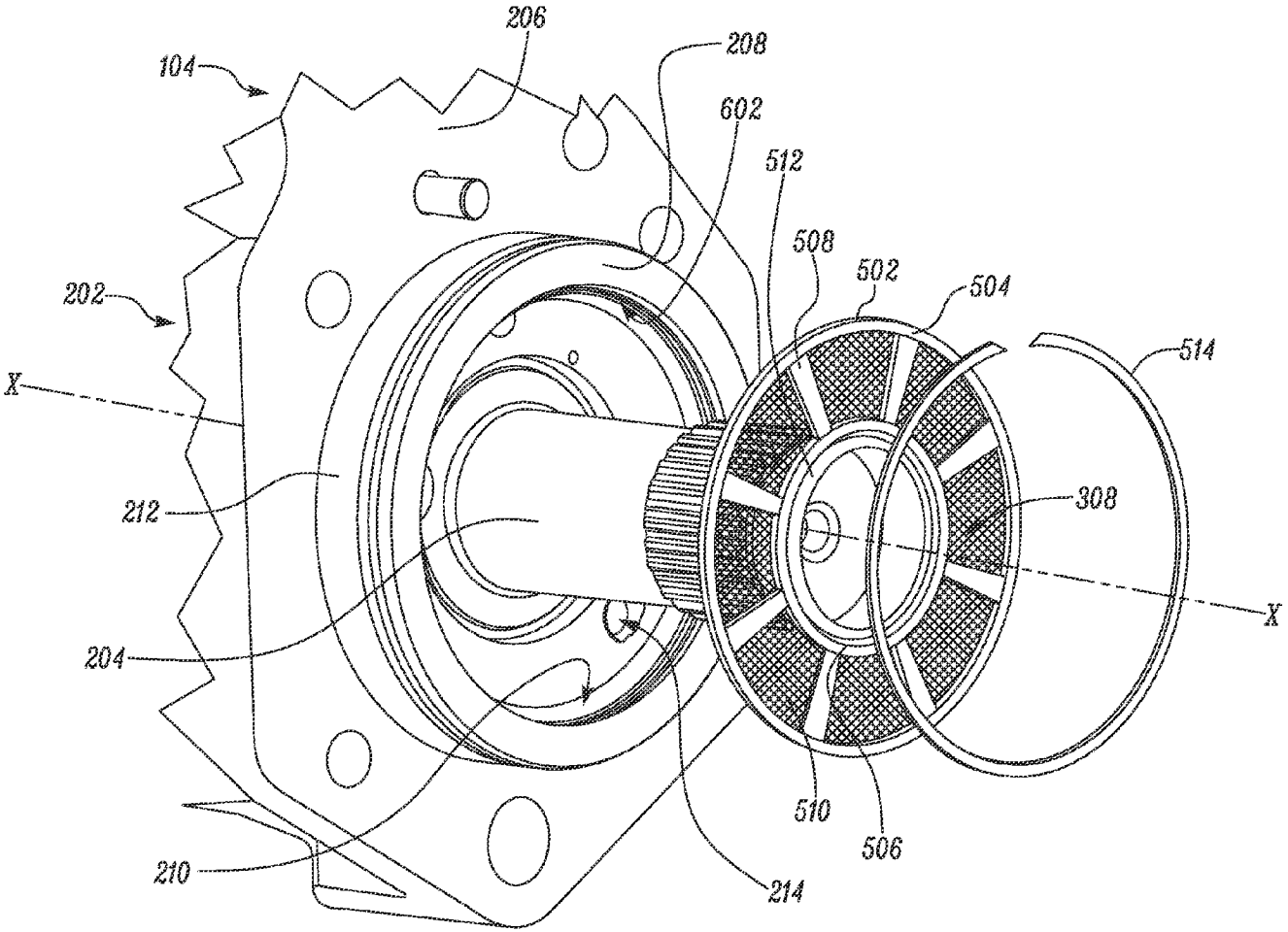
FIG. 5 is an exploded view of an alternate configuration of the retainer, according to another embodiment of the present disclosure.
Figure 6:
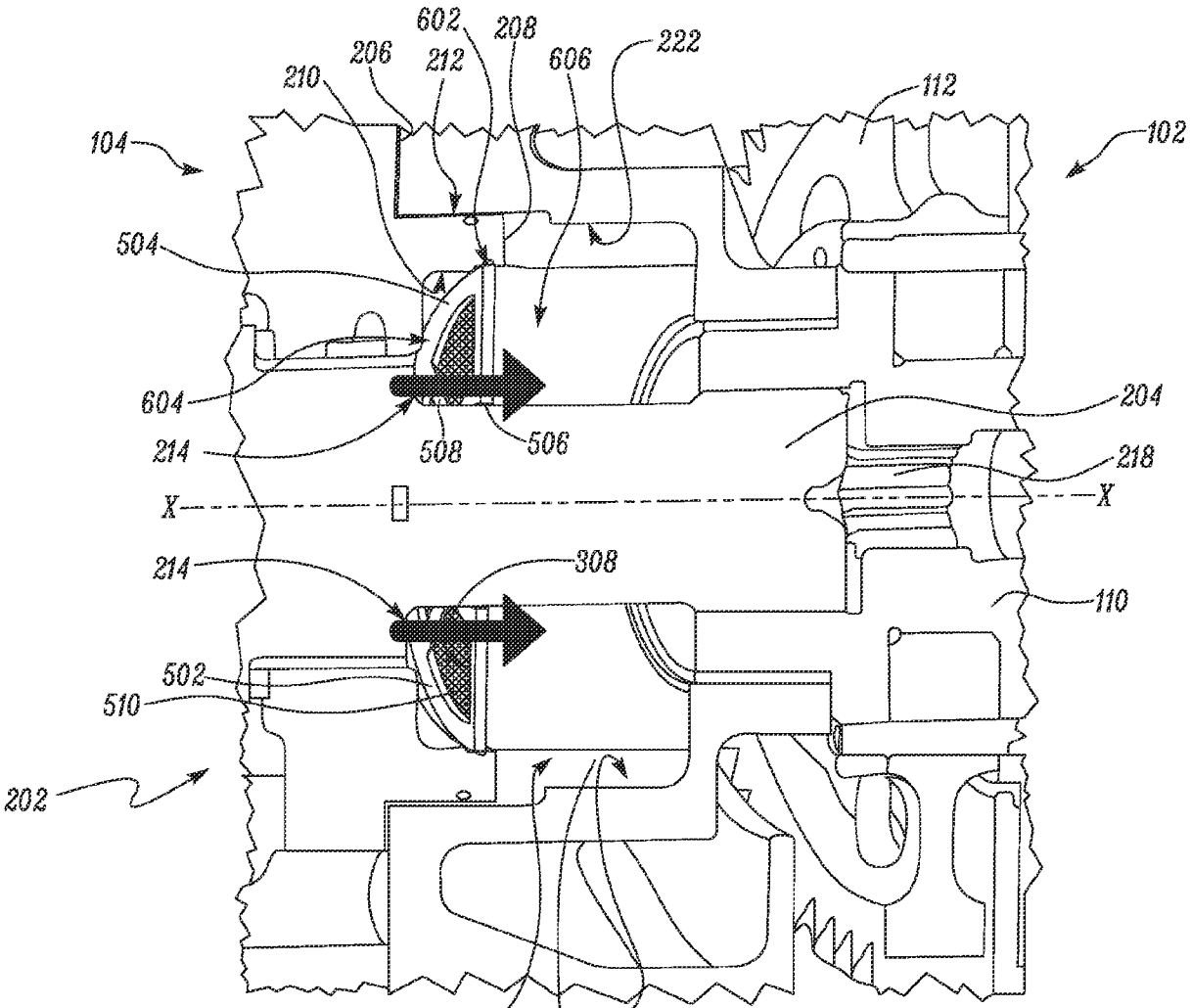
FIG. 6 shows a perspective cross sectional view of another assembly including the gear, the fuel pump and the retainer of FIG. 5.

FIGS. 5 and 6 illustrate a second configuration of the retainer 502, according to another embodiment of the present disclosure. As shown in FIG. 5, the retainer 502 includes the first rim 504 and the second rim 506 having a circular ring like structure. The first and second rims 504, 506 of the retainer 502 are coaxial and spaced apart from each other in the radial direction. More particularly, the first and second rims 504, 506 of the retainer 502 are substantially concentric to each other.

In the illustrated embodiment, the first rim 504 of the retainer 502 has a diameter greater than that of the second rim 506. For example, the diameter of the first rim 504 may have a diameter 3 to 5 times of the diameter of the second rim 506. Also, the diameter of the second rim 506 may be substantially equal to the diameter of the pump shaft 204 such that the second rim 506 may fit closely around the pump shaft 204. Further, in one embodiment, a plurality of support ribs 508 may be provided on the retainer 502 in a spaced apart arrangement. The support ribs 508 may extend radially between the first and second rims 504, 506.

The retainer 502 also includes a substantially planar wall 510 attached to and extending between the first and second rims 504, 506. The planar wall 510 of the retainer 502 is perpendicular to the longitudinal axis X-X. As shown, the first and second rims 504, 506 of the retainer 502 are configured as concentric circles in the same plane as the planar wall 510. The planar wall 510 may include the plurality of apertures 308.

In one embodiment, a sealing ring 512 may be provided between the pump shaft 204 and the second rim 506 in order to dynamically seal the second rim 506 of the retainer 502 and the pump shaft 204. Additionally, another sealing ring 514 may also be provided between the first rim 504 of the retainer 502 and the inner circumference 210 of the mounting surface 208 in order to prevent an out flow of the oil when the pump shaft 204 rotates.

FIG. 6 shows a cross sectional view of the retainer 502 provided within the housing 202 of the fuel pump 104. In the present embodiment, the retainer 502 may be received into a groove 602 provided on the inner circumference 210 of the mounting surface 208 of the fuel pump 104. Further, the retainer 502 defines the first volume 604 and the second volume 606 within the housing 202 of the fuel pump 104 and the gear case 102 respectively. More particularly, the first volume 604 is defined on the interior side and the second volume 606 is defined on the exterior side of the planar wall 510 with respect to the direction of the oil flow. As shown by arrows, the oil may flow in the axial direction from the fuel pump 104 through the retainer 502 towards the gear case 102. The plurality of apertures 308 on the planar wall 510 may retain the particulate contaminants within the first volume 604 and prevent the particulate contaminants from entering into the second volume 606. For example, the apertures 308 may be sized as small as approximately 100 microns. In another example, the apertures 308 may be larger than 100 microns. The size of the apertures 308 may vary based on the level of protection required.

Industrial Applicability

Debris resulting from a catastrophic failure of the fuel pump may mix with the lubricating oil draining from the fuel pump into the gear case. This debris which is mixed with the oil may cause damage to the engine gear train and/or associated components of the engine present downstream of the drained oil flow.

The retainer 106, 502 disclosed herein is disposed about the pump shaft 204. The plurality of apertures 308 present on the retainer 106, 502 may prevent the debris or the particulate contaminants from flowing downstream into the gear case 102. The retainer 106, 502 may contain or collect these particulate contaminants within an area or cavity defined in relation with the retainer 106, 502 and thereby prevent damage to the gear train 108 present within the gear case 102.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof

What is claimed is:

1. A fuel pump comprising:

a housing;

a rotatable pump shaft disposed within the housing, one end of the rotatable pump shaft being attachable to a gear; and a retainer disposed within the housing and located about the rotatable pump shaft, the retainer comprising:

a first rim and a second rim, wherein the first rim and the second rim are spaced apart from each other; and a side wall attached to and extending between the first rim and the second rim, the side wall having a plurality of apertures, the side wall defining a first and second volume within the housing, wherein the plurality of apertures is configured to allow a fluid flow from the first volume to the second volume while retaining particulate contaminants larger than a size of the apertures within the first volume.

2. The fuel pump of claim 1, wherein the first volume is defined on an interior side and the second volume is defined on an exterior side of the side wall with respect to the pump shaft, the exterior side being positioned radially outwards of the interior side.

3. The fuel pump of claim 1, wherein the first rim and the second rim are configured to have a circular ring-like structure.

4. The fuel pump of claim further 1, comprising a mesh disposed on a surface of the side wall configured to provide mechanical strength.

5. The fuel pump of claim 1, wherein a diameter of the first rim and a diameter of the second rim is greater than a diameter of the pump shaft.

6. A fuel pump comprising:

a housing;

a rotatable pump shaft disposed within the housing, one end of the rotatable pump shaft being attachable to a gear; and a retainer disposed within the housing and located about the rotatable pump shaft, the retainer comprising:

a first rim and a second rim, wherein the first rim and the second rim are spaced apart from and coaxial to each other; and a substantially planar wall attached to and extending between the first rim and the second rim , the planar wall having a plurality of apertures, the surface defining a first and second volume within the housing, wherein the plurality of apertures is configured to allow a fluid flow from the first volume to the second volume while retaining particulate contaminants larger than a size of the apertures within the first volume.

7. The fuel pump of claim 6, wherein the first volume is defined on an interior side and the second volume is defined on an exterior side of the planar wall with respect to a direction of the fluid flow.

8. The fuel pump of claim 6, wherein the first rim and the second rim are configured as concentric circles in the same plane as the planar wall.

9. The fuel pump of claim 8 further comprising a plurality of support ribs provided in a spaced apart arrangement and radially extending between the first rim and the second rim.

10. The fuel pump of claim 8, wherein a diameter of the second rim is substantially equal to a diameter of the pump shaft.

11. The fuel pump of claim 8, wherein a diameter of the first rim is greater than a diameter of the second rim.

12. The fuel pump of claim 8 further comprising a sealing ring provided between the pump shaft and the second rim.

13. An engine comprising:

an engine block;

a gear case having a gear train comprising one or more gears; and a fuel pump mechanically coupled to the gear train, the fuel pump comprising:

a housing;

a rotatable pump shaft disposed within the housing, one end of the rotatable pump shaft being configured to cooperate with a gear of the gear train; and a retainer disposed within the housing and located about the rotatable pump shaft, the retainer comprising:

a first rim and a second rim, wherein the first rim and the second rim are spaced apart from each other; and a wall extending between the first rim and the second rim, the wall having a plurality of apertures, the wall defining a first and second volume within the housing, wherein the plurality of apertures is configured to allow a fluid flow from the first volume to the second volume while retaining particulate contaminants larger than a size of the apertures within the first volume.

14. The engine of claim 13, wherein the second volume is in fluid communication with the gear train.

15. The engine of claim 13, wherein the first volume is defined on an interior side and the second volume is defined on an exterior side of the wall with respect to the pump shaft, the exterior side being positioned radially outwards of the interior side.

16. The engine of claim 13, wherein the first rim and the second rim are configured to have a circular ring like structure.

17. The engine of claim 13 further comprising a mesh disposed on a surface of the wall for providing mechanical strength.

18. The engine of claim 13, wherein a diameter of the first rim and a diameter of the second rim is substantially greater than a diameter of the pump shaft.

19. The engine of claim 13, wherein the first rim and the second rim are configured as concentric circles in the same plane as the planar wall.

20. The engine of claim 19, wherein the second rim is substantially equal to a diameter of the pump shaft.

* * * * *